US009896789B2

(12) United States Patent
Okuma et al.

(10) Patent No.: US 9,896,789 B2
(45) Date of Patent: Feb. 20, 2018

(54) WEAVING LOOM

(71) Applicant: CLOVER MFG. CO., LTD., Osaka-shi, Osaka (JP)

(72) Inventors: Atsuko Okuma, Osaka (JP); Katsuhiko Ozeki, Osaka (JP)

(73) Assignee: CLOVER MFG. CO., LTD., Osaka (JP)

( * ) Notice: Subject to any disclaimer, the term of this patent is extended or adjusted under 35 U.S.C. 154(b) by 19 days.

(21) Appl. No.: 15/145,525

(22) Filed: May 3, 2016

(65) Prior Publication Data

US 2016/0340810 A1 Nov. 24, 2016

(30) Foreign Application Priority Data

May 20, 2015 (JP) ..... 2015-103250

(51) Int. Cl.
*D03D 29/00* (2006.01)

(52) U.S. Cl.
CPC ..... *D03D 29/00* (2013.01)

(58) Field of Classification Search
CPC .... D03D 29/00; D03D 41/00; D03D 15/0022; D04B 3/00; D04B 39/00; D04B 11/00; A63H 9/00
See application file for complete search history.

(56) References Cited

U.S. PATENT DOCUMENTS 737,073 A * 8/1903 Bush ..... D03D 19/00 139/29
829,474 A * 8/1906 Hooper ..... D03D 29/00 139/33
1,160,132 A * 11/1915 Bliss ..... D03D 29/00 139/33
1,277,927 A * 9/1918 Heiss ..... D04B 17/00 139/33.5
1,318,604 A * 10/1919 Schneider ..... D04B 39/00 66/4
2,094,505 A * 9/1937 Thackeray ..... D03D 29/00 139/33
2,108,424 A * 2/1938 Bakely ..... D04D 11/00 28/150
2,118,142 A * 5/1938 Belash ..... D03D 29/00 28/152
2,139,879 A * 12/1938 Clark ..... D03D 29/00 139/33
2,150,187 A * 3/1939 Raba ..... D03D 29/00 139/33
2,153,764 A * 4/1939 Lewis ..... D03D 29/00 28/152
2,166,415 A * 7/1939 Lervad ..... D03D 29/00 139/33

(Continued)

*Primary Examiner* — Bobby Muromoto, Jr.
(74) *Attorney, Agent, or Firm* — Hamre, Schumann, Mueller & Larson, P.C.

(57) ABSTRACT

A handicraft weaving loom with improved usability is provided. The weaving loom includes a main body having a pair of edge portions that are spaced apart from each other in a predetermined first direction. Each edge portion extends elongated in a second direction perpendicular to the first direction. The weaving loom further includes a yarn catch member provided with a yarn catch portion for holding threads in parallel. The yarn catch member is detachably attached to one of the two edge portions.

18 Claims, 16 Drawing Sheets

(56) References Cited

U.S. PATENT DOCUMENTS 2,190,813 A * 2/1940 Walker ..... D03D 29/00 139/34
2,241,199 A * 5/1941 Hines ..... D03D 29/00 139/33
2,242,210 A * 5/1941 Gallinger ..... D03D 29/00 139/33
2,253,329 A * 8/1941 Gallinger ..... D03D 29/00 139/33
2,360,416 A * 10/1944 Gray ..... D03D 29/00 28/150
2,601,222 A * 6/1952 Wehrli ..... D03D 29/00 139/34
2,663,066 A * 12/1953 Berger ..... D03D 29/00 28/152
2,802,255 A * 8/1957 Wallach ..... D03D 29/00 139/34
3,137,320 A * 6/1964 Parton ..... D03D 29/00 139/33
3,636,987 A * 1/1972 Forby ..... D03D 29/00 28/151
3,708,839 A * 1/1973 Prince ..... D03D 29/00 28/150
3,757,395 A * 9/1973 Nepon ..... D03D 29/00 28/152
3,800,372 A * 4/1974 Daoust ..... D03D 29/00 28/152
3,959,535 A * 5/1976 Stewart ..... D04B 3/00 428/102
3,973,413 A * 8/1976 Tichenor ..... D04B 5/00 66/1 A
4,023,245 A * 5/1977 Zaltzman ..... D03D 29/00 28/152
4,109,355 A * 8/1978 Davitian ..... D03D 29/00 28/151
4,160,467 A * 7/1979 Woodruff ..... D03D 29/00 139/33
RE30,656 E * 6/1981 Davitian ..... D03D 29/00 28/151
4,462,432 A * 7/1984 Sajo ..... D03D 29/00 139/33
D280,149 S * 8/1985 De Jiacomo ..... D3/26
D310,672 S * 9/1990 Harvey ..... D15/66
5,413,150 A * 5/1995 Townsend ..... D03D 29/00 139/34
6,149,437 A * 11/2000 Corliss ..... B44C 3/06 139/29
6,453,951 B1 * 9/2002 Kuwabara ..... D03C 9/02 139/33
7,762,284 B2 * 7/2010 Ricks ..... D04D 1/04 139/29
8,066,035 B1 * 11/2011 Stevens ..... D03D 29/00 139/29
8,132,596 B2 * 3/2012 Weidler ..... D03D 29/00 139/29
8,596,096 B1 * 12/2013 Russell ..... D04B 3/00 66/4
9,121,117 B2 * 9/2015 Teramoto ..... D04D 1/04
9,506,171 B2 * 11/2016 Nitta ..... D03D 29/00
D773,174 S * 12/2016 Okuma ..... D3/26
2004/0069363 A1 * 4/2004 D'Estais ..... D03D 29/00 139/1 R
2005/0205150 A1 * 9/2005 Jenner ..... D03D 29/00 139/11
2005/0247745 A1 * 11/2005 Spor ..... D03D 29/00 223/48
2006/0157137 A1 * 7/2006 Sayler ..... D03D 29/00 139/29
2007/0270010 A1 * 11/2007 Walter ..... D03D 29/00 439/259
2008/0156043 A1 * 7/2008 Gustin ..... D04B 5/00 66/4
2008/0173368 A1 * 7/2008 Flodin ..... D03D 29/00 139/33
2009/0293982 A1 * 12/2009 Skaflestad ..... D03D 29/00 139/34
2010/0212770 A1 * 8/2010 Weidler ..... D04D 1/04 139/33
2010/0269947 A1 * 10/2010 Spear ..... D03D 29/00 139/29
2011/0259465 A1 * 10/2011 Schaub ..... D03D 29/00 139/29
2012/0047960 A1 * 3/2012 Sasur ..... D04B 5/00 66/1 A
2013/0291994 A1 * 11/2013 Wijerama ..... D03D 29/00 139/29
2014/0166150 A1 * 6/2014 Teramoto ..... D04D 1/04 139/29
2016/0032500 A1 * 2/2016 Novak ..... D03D 29/00 28/152
2016/0340810 A1 * 11/2016 Okuma ..... D03D 29/00

* cited by examiner

WEAVING LOOM

BACKGROUND OF THE INVENTION

1. Field of the Invention

The present invention relates to a handicraft weaving loom for use in making woven products from yarn material such as woolen yarn.

2. Description of Related Art

Conventionally, handicraft weaving looms for making woven products are known (see Japanese Utility Model Registration No. 3186258, for example). In the weaving loom described in Japanese Utility Model Registration No. 3186253, a pair of edges of a rectangular plate have notches (yarn catch portions) for catching a warp yarn in parallel. A bending line that extends substantially in parallel with the edges having the yarn catch portions is provided at an appropriate position on the plate. This bending line is a processed portion along which the plate can be easily bent. With this configuration, a woven fabric that has been woven between the pair of yarn catch portions can be easily released from the weaving loom.

However, although the thus configured weaving loom allows a woven fabric to be easily released therefrom, there is a concern that if the plate is bent along the bending line during a weaving operation, a warp yarn caught on the yarn catch portions may come off. Accordingly, such a conventional weaving loom has room for improvement in terms of usability.

SUMMARY OF THIS INVENTION

The present invention has been proposed in view of these circumstances, and it is an object thereof to provide a handicraft weaving loom with improved usability.

According to an aspect of the present invention, there is provided a handicraft weaving loom that includes: a main body having a first edge portion and a second edge portion that are spaced apart from each other in a first direction, where each edge portion extends in a second direction perpendicular to the first direction; and a first yarn catch member provided with a yarn catch portion for holding threads in parallel, where the first yarn catch member is detachably attached to the first edge portion of the main body.

In an embodiment, the weaving loom further includes a second yarn catch member detachably attached to the second edge portion of the main body.

In an embodiment, the first yarn catch member is slidable along the first edge portion.

In an embodiment, the main body is provided with a slide stopper to come into contact with the first yarn catch member.

In an embodiment, the main body includes a base plate and an inclined plate. The base plate has an upper face and a lower face, and the inclined plate is formed integral with the base plate. The above-mentioned first edge portion is formed by the inclined plate.

In an embodiment, the first yarn catch member is provided with a first extension and a second extension both of which are disposed opposite to the yarn catch portion. In use, the first and second extensions are caused to flank the inclined plate in the thickness direction of the inclined plate, so that the yarn catch member is detachably attached to the inclined plate.

In an embodiment, each extension is made up of a plurality of extending pieces spaced apart from each other in the second direction, and the extending pieces of the first extension are positioned so as not to overlap with the extending pieces of the second extension as viewed in the thickness direction of the inclined plate.

In an embodiment, the first yarn catch member and the inclined plate are formed with a first engagement portion and a second engagement portion, respectively, where the first and the second engagement portions are configured to come into engagement with each other.

In an embodiment, the first engagement portion is provided at the first extension or at the second extension.

In an embodiment, one of the first and the second engagement portions is formed with a recess, and the other one is formed with a protrusion to be fitted into the recess.

In an embodiment, the lower face of the base plate is provided with a leg that projects in the thickness direction of the base plate.

In an embodiment, the lower face of the base plate is provided with a mark that is located at the middle of the base plate in the first direction.

In an embodiment, the main body is provided with a coupling portion for coupling with another weaving loom.

In an embodiment, the coupling portion includes a separation preventing structure for preventing detachment of another weaving loom.

Other features and advantages of the present invention will become more apparent from the detailed description given below with reference to the attached drawings.

DESCRIPTION OF THE PREFERRED EMBODIMENTS

Hereinafter, preferred embodiments of the present invention will be specifically described with reference to the drawings.

FIGS. 1 to 7 show an embodiment of a weaving loom according to the present invention. A weaving loom A of this embodiment includes a main body 1 and a pair of yarn catch members 2, and is used to manually make a woven product from yarn material such as woolen yarn.

Figure 6:
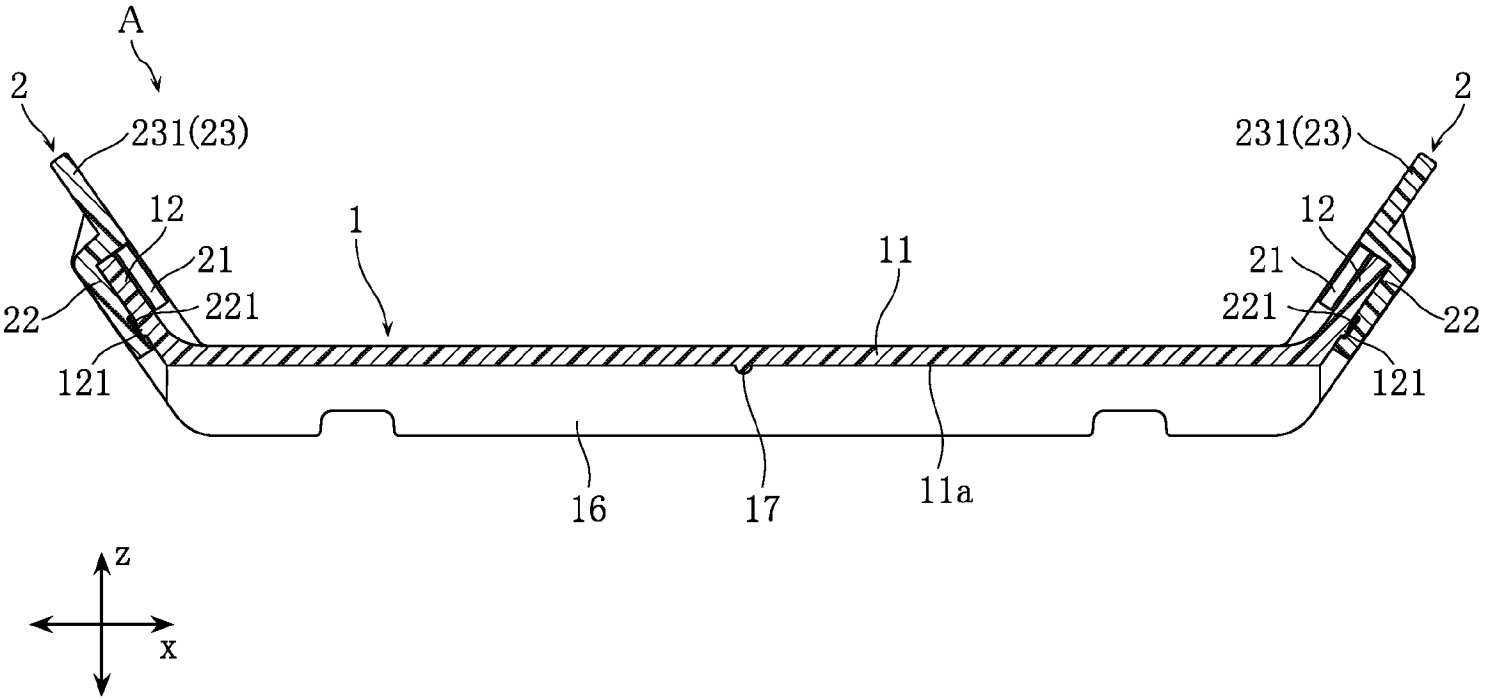
FIG. 6 is an enlarged cross-sectional view taken along the line VI-VI in FIG. 3.

The main body 1 includes a flat base plate 11, and a pair of inclined plates 12 that continue from the base plate 11. The base plate 11 is substantially rectangular when viewed from above. The pair of inclined plates 12 continue respectively from a pair of opposite sides (end portions) of the base plate 11 that are spaced apart from each other in a direction x. The inclined plates 12 are inclined upward away in the direction x from the end portions of the base plate 11. As shown in FIG. 6, protrusions 121 are formed at appropriate positions on the outer faces of the inclined plates 12.

As shown in FIGS. 1 to 4, etc., the main body 1 is provided with slide stoppers 13. In this embodiment, the stoppers 13 are arranged at end portions (two positions) of the inclined plates 12 in a direction y (direction perpendicular to the direction x), and are each in the shape of a flange that projects on both sides of the corresponding inclined plate 12 in the thickness direction thereof. The function of the stoppers 13 will be described later.

The base plate 11 is provided with, at both ends thereof in the direction y, coupling portions 14 and 15. The coupling portions 14 and 15 are for coupling with the main body 1 of another weaving loom A. The coupling portions 14 and 15 will in detail.

As shown in FIGS. 3 to 5 and 7, a lower face 11*a* of the base plate 11 is provided with leg portions 16. The leg portions 16 project in a thickness direction z (direction perpendicular to both, the direction x and the direction y) of the base plate 11. The plurality of leg portions 16 are arranged so as to be spaced apart from each other near both ends of the base plate 11 in the direction y, and all of them are long in the direction x. The main body 1 is formed in one piece from, for example, a synthetic resin having a predetermined strength such as ABS resin (acrylonitrile-butadiene-styrene resin).

Figure 7:
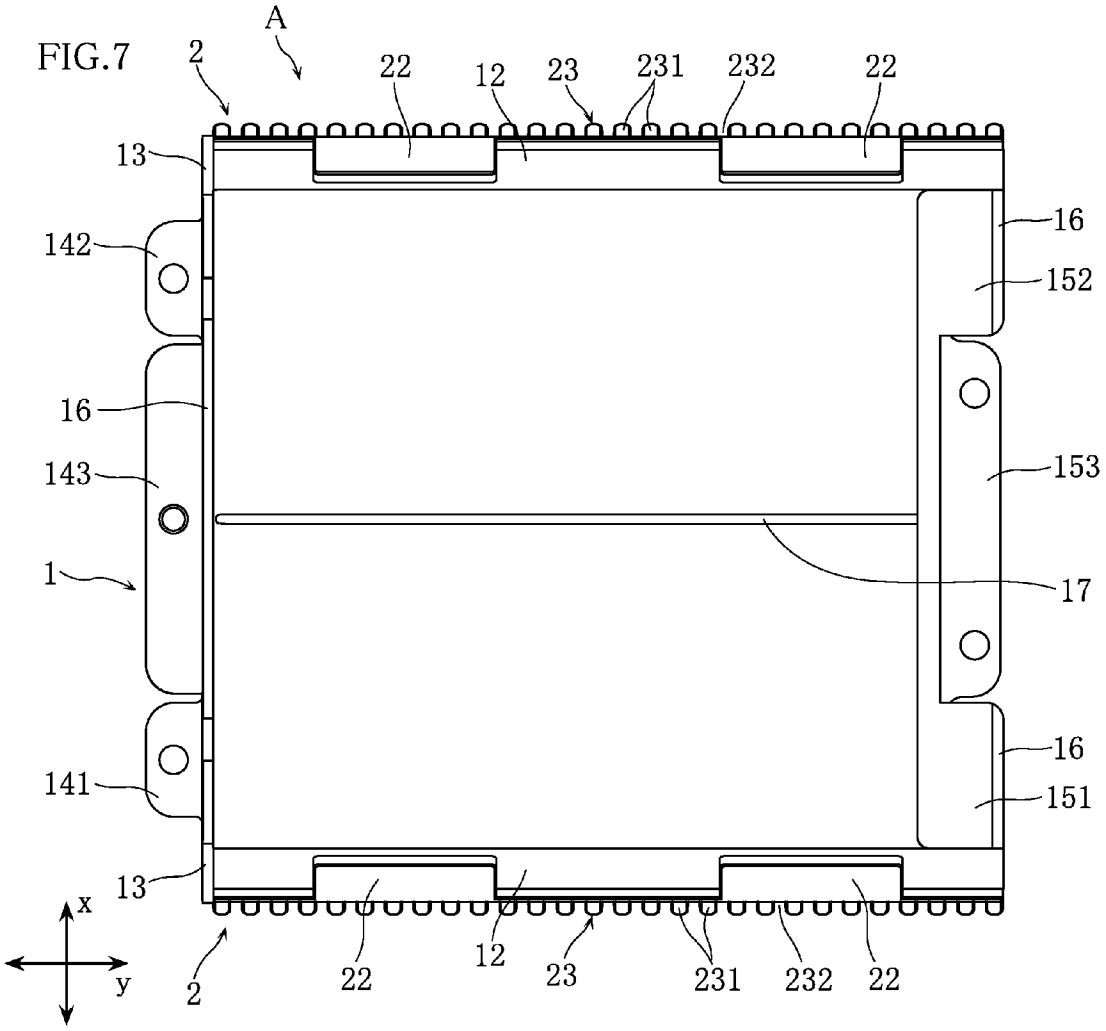
FIG. 7 is a bottom view of the weaving loom shown in FIG. 1.

As shown in FIGS. 6 and 7, the lower face 11*a* of the base plate 11 is provided with a mark 17. The mark 17 is positioned at the middle of the base plate 11 in the direction x and extends along the direction y.

Figure 1:
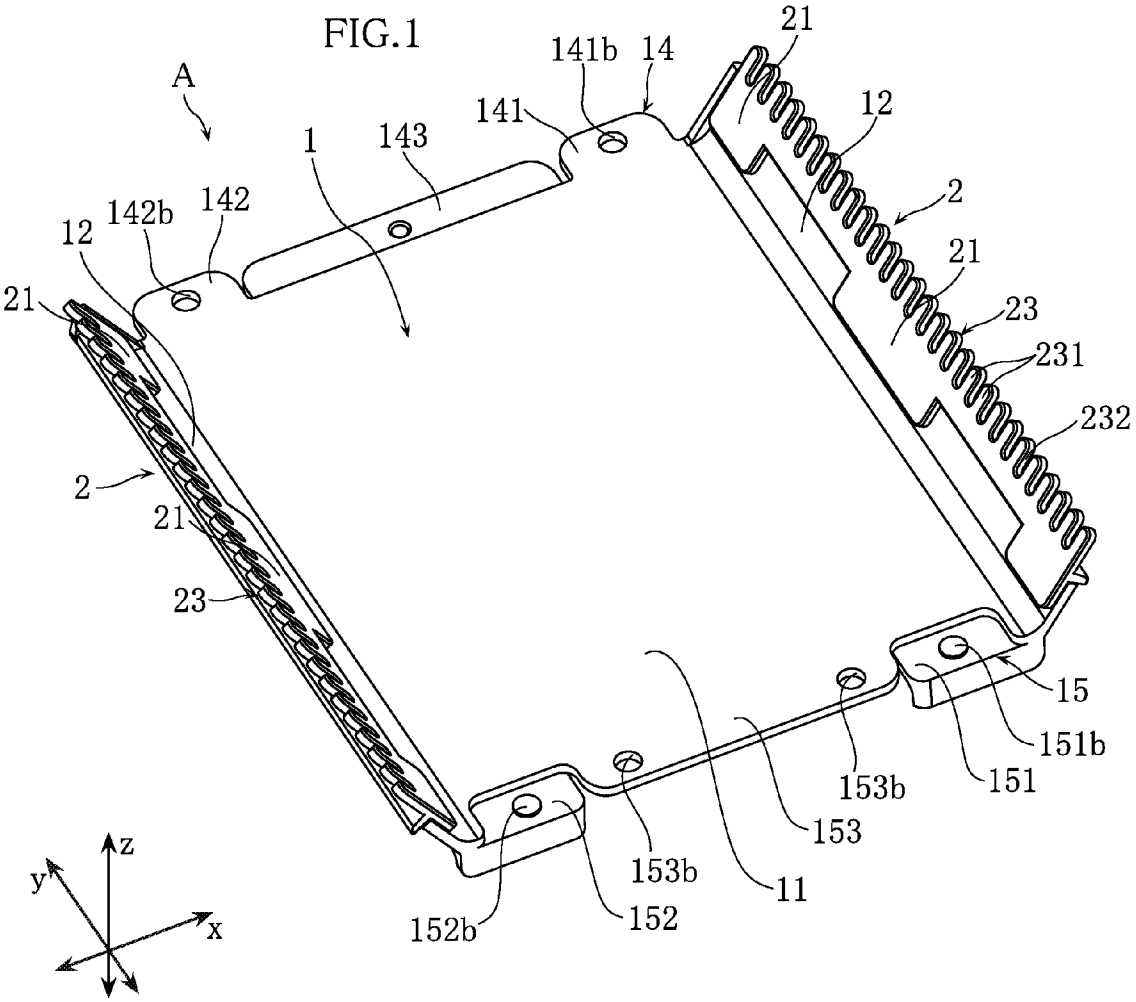
FIG. 1 is a perspective view showing an example of a weaving loom according to the present invention.
Figure 2:
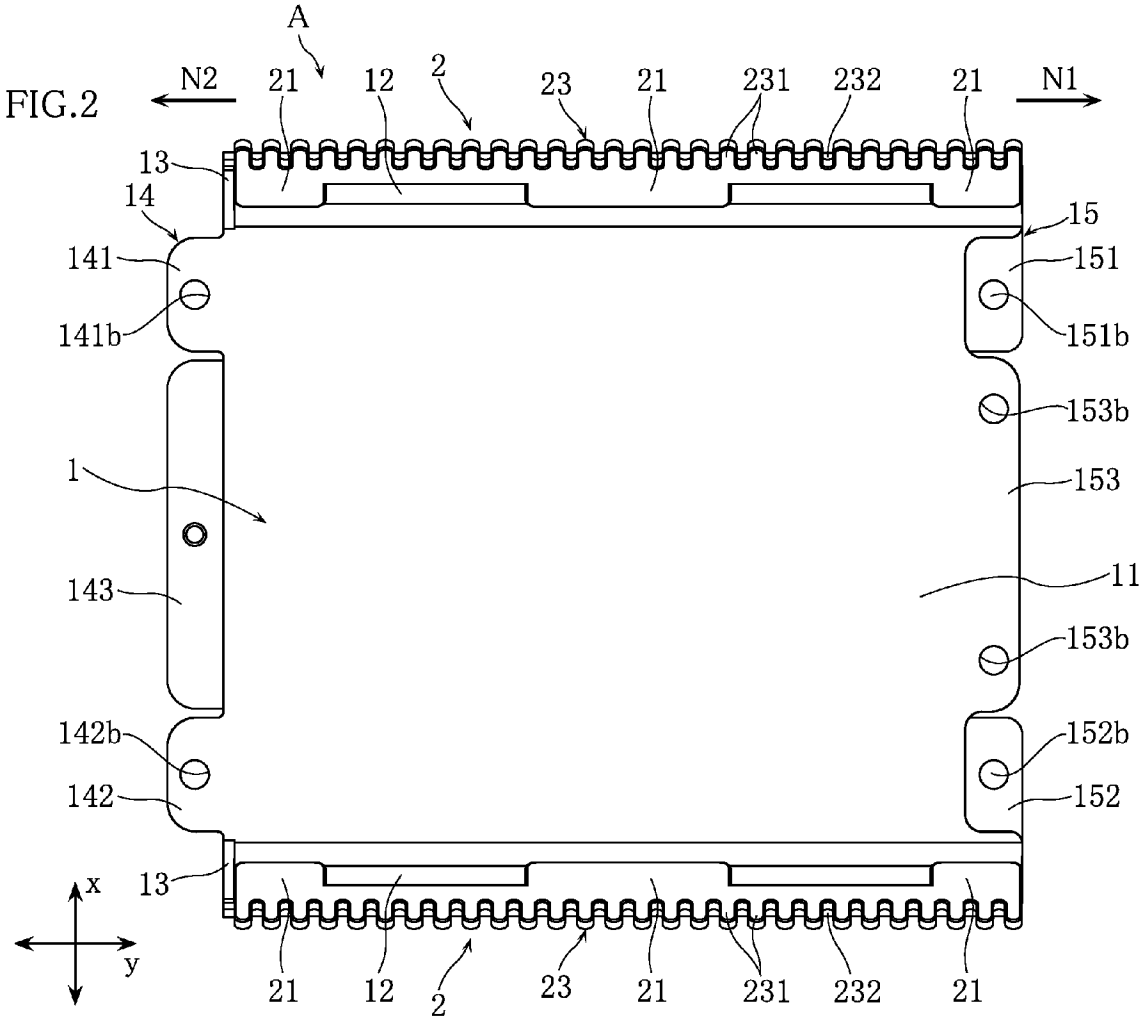
FIG. 2 is a plan view of the weaving loom shown in FIG. 1.
Figure 3:
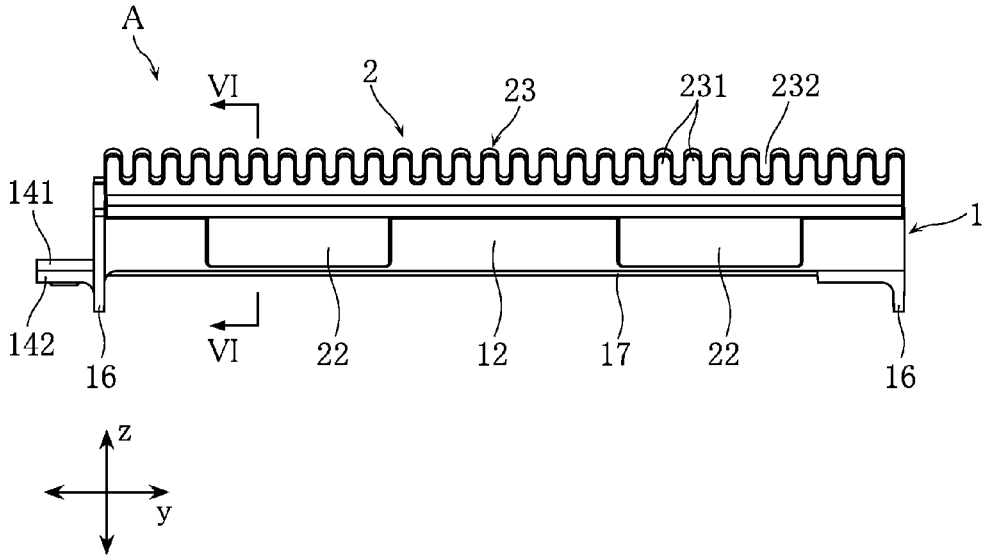
FIG. 3 is a front view of the weaving loom shown in FIG. 1.

The yarn catch members 2 are detachably attached to a pair of edge portions of the main body 1 in the direction x. In this embodiment, tip ends of the inclined plates 12 (of the main body 1) correspond to the edge portions. As shown in FIGS. 1 to 3, each of the yarn catch members 2 has an extension (made up of a plurality of extending pieces 21), another extension (made up of a plurality of extending pieces 22), and a yarn catch portion 23. The yarn catch members 2 are formed in one piece from, for example, a synthetic resin having a predetermined strength such as ABS resin (acrylonitrile-butadiene-styrene resin).

Figure 5:
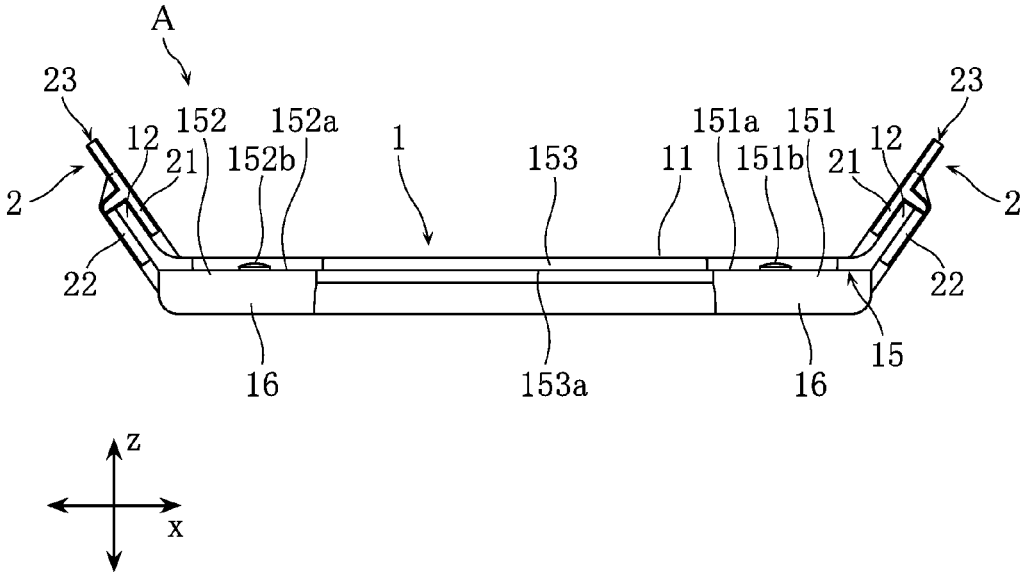
FIG. 5 is a right side view of the weaving loom shown in FIG. 1.

The plurality of extending pieces 21 are spaced apart from each other in the direction y, and all of them are in the shape of plates that are long in the direction y. The plurality of extending pieces 22 are also spaced apart from each other in the direction y, and all of them are in the shape of plates that are long in the direction y. The plurality of extending pieces 21 and the plurality of extending pieces 22 are positioned with a predetermined gap interposed therebetween in their thickness direction. The plurality of extending pieces 21 and 22 are arranged on the base ends of the yarn catch members 2. As shown in FIGS. 5, 6, etc., when each of the yarn catch members 2 is attached, the extending pieces 21 and 22 hold the corresponding inclined plate 12 from both sides in the thickness direction thereof. As seen from a comparison between FIGS. 2 and 3, the plurality of extending pieces 21 and the plurality of extending pieces 22 do not to overlap when viewed in the thickness direction of the inclined plate 12.

As shown in FIG. 6, recesses 221 are formed at appropriate positions on the extending pieces 22. When the yarn catch members 2 are attached, the protrusions 121 of the inclined plates 12 are fitted into the recesses 221.

The yarn catch portions 23 are for catching a warp yarn in parallel, and are arranged on the tip ends of the yarn catch members 2. Each of the yarn catch portions 23 has a comb-teeth shape in which a plurality of projections 231 are arranged side by side in the direction y, and a plurality of grooves 232 are formed between the adjacent projections 231. When the yarn catch members 2 are attached to the inclined plates 12, the tip ends of the projections 231 forming the yarn catch portions 23 are oriented obliquely upward.

When the yarn catch members 2 are attached to the inclined plates 12 (the main body 1), the yarn catch members 2 are movable to one side in the direction y (side indicated by the arrow N1 in FIG. 2). The yarn catch members 2 are detachable from the main body 1 by sliding the yarn catch members 2 in the direction of the arrow N1. On the other hand, the ends of the yarn catch members 2 at the opposite side in the direction y are abut against the stoppers 13. Accordingly, the yarn catch members 2 are prevented by the stoppers 13 from moving to the opposite side in the direction y (side indicated by the arrow N2 in FIG. 2).

Figure 4:
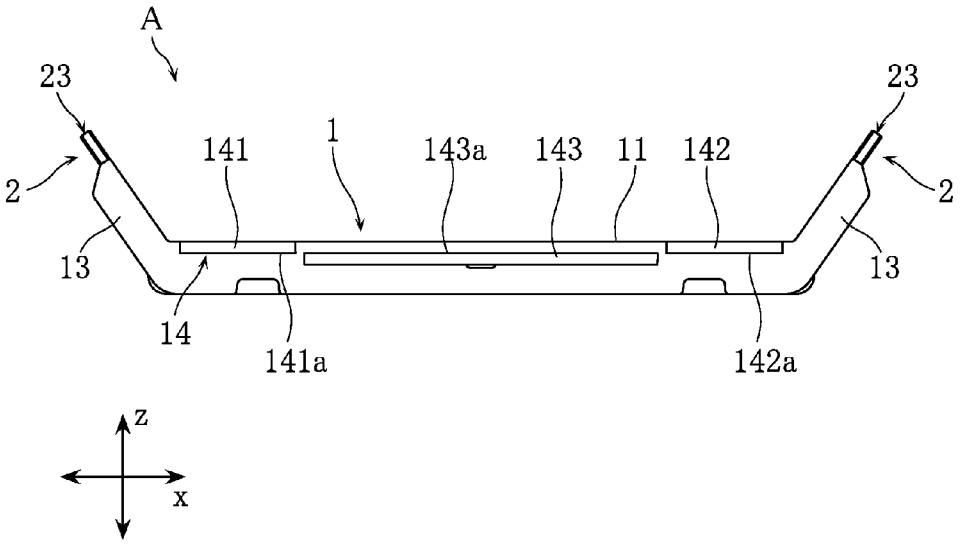
FIG. 4 is a left side view of the weaving room shown in FIG. 1.

The coupling portion 14 is provided at one end of the base plate 11 in the direction y. The coupling portion 14 has two coupling plates 141 and 142 spaced apart from each other in the direction x, and a coupling plate 143 positioned between the coupling plates 141 and 142. As shown in FIG. 4, an upper face 143*a* of the coupling plate 143 is at substantially the same position in the thickness direction z as lower faces 141*a* and 142*a* of the coupling plates 141 and 142. Through-holes 141*b* and 142*b* are formed through the coupling plates 141 and 142.

The coupling portion 15 is provided at the other end of the base plate 11 in the direction y. The coupling portion has two coupling plates 151 and 152 spaced apart from each other in the direction x, and a coupling plate 153 positioned between the coupling plates 151 and 152. As shown in FIG. 5, a lower face 153*a* of the coupling plate 153 is at substantially the same position in the thickness direction z as upper faces 151*a* and 152*a* of the coupling plates 151 and 152. Protrusions 151*b* and 152*b* projecting upward are formed on the coupling plates 151 and 152. Two through-holes 153*b* and 153*b* are formed through the coupling plate 153.

Figure 8:
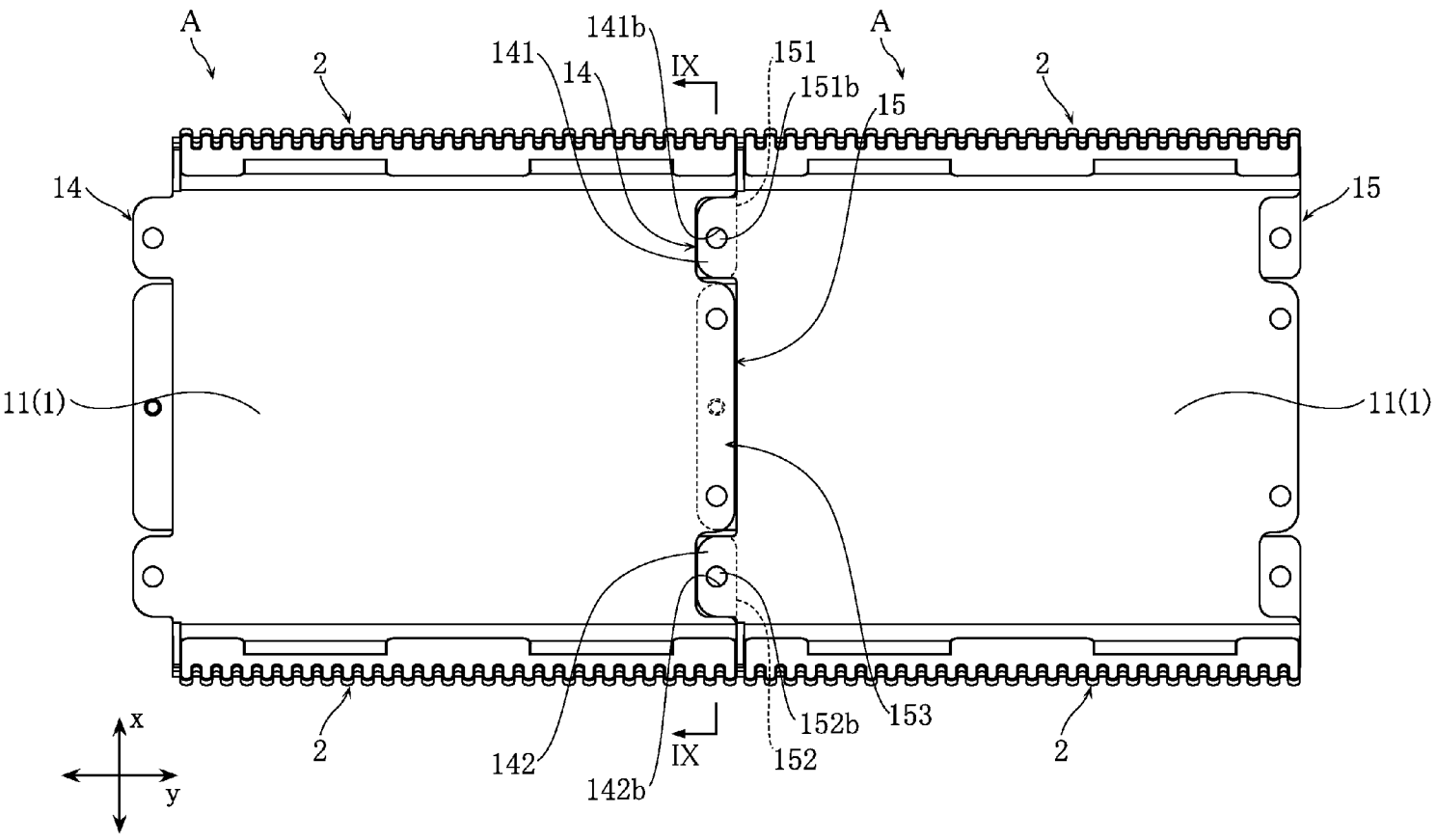
FIG. 8 is a plan view showing a state in which two weaving looms identical to the one shown in FIG. 1 are coupled.
Figure 9:
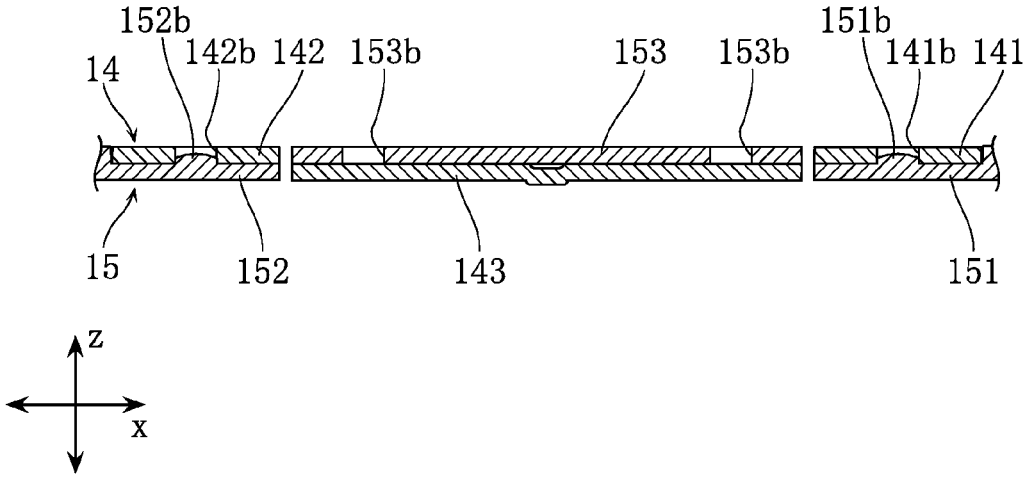
FIG. 9 is a partially enlarged cross-sectional view taken along the line XX-XX in FIG. 8.
Figure 10:
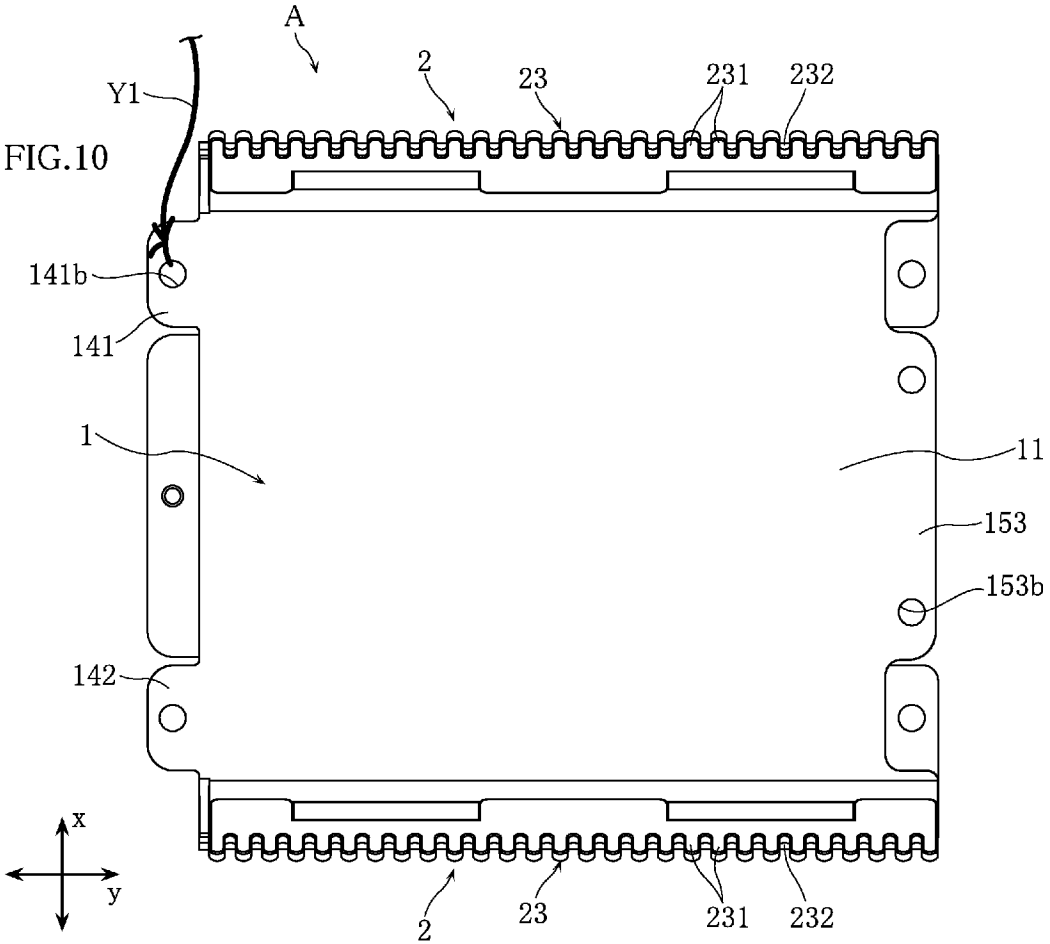
FIG. 10 is a plan view illustrating a method for using the weaving loom.

FIG. 8 shows a state in which two weaving looms A are coupled. In the two weaving looms A shown in FIG. 8, the base plates 11 (the main bodies 1) are coupled by the coupling portion of the weaving loom A positioned on the left side in the figure and the coupling portion 14 of the weaving loom A positioned on the right side in the figure. Specifically, as clearly seen in FIG. 9, the coupling plates 141 and 142 of the coupling portion 14 and the coupling plates 151 and 152 of the coupling portion 15 overlap each other, and the protrusions 151*b* and 152*b* are fitted into the through-holes 141*b* and 142*b*. Furthermore, the coupling plate 143 of the coupling portion 14 and the coupling plate 153 of the coupling portion 15 overlap each other. The upper-lower positional relationship between the coupling plates 141 and 142 and the coupling plates 151 and 152 is opposite to the upper-lower positional relationship between the coupling plate 143 and the coupling plate 153. With this configuration, the coupled state of the coupled base plates 11 is maintained, preventing the base plates 11 from being accidentally detached from each other. The coupling plates 141 to 143 and 151 to 153, the through-holes 141*b* and 142*b*, and the protrusions 151*b* and 152*b* constitute a separation preventing structure in the present invention.

Next, methods for performing a weaving operation using the weaving loom A and actions of the weaving loom A will be described with reference to FIGS. 10 to 16.

Figure 11:
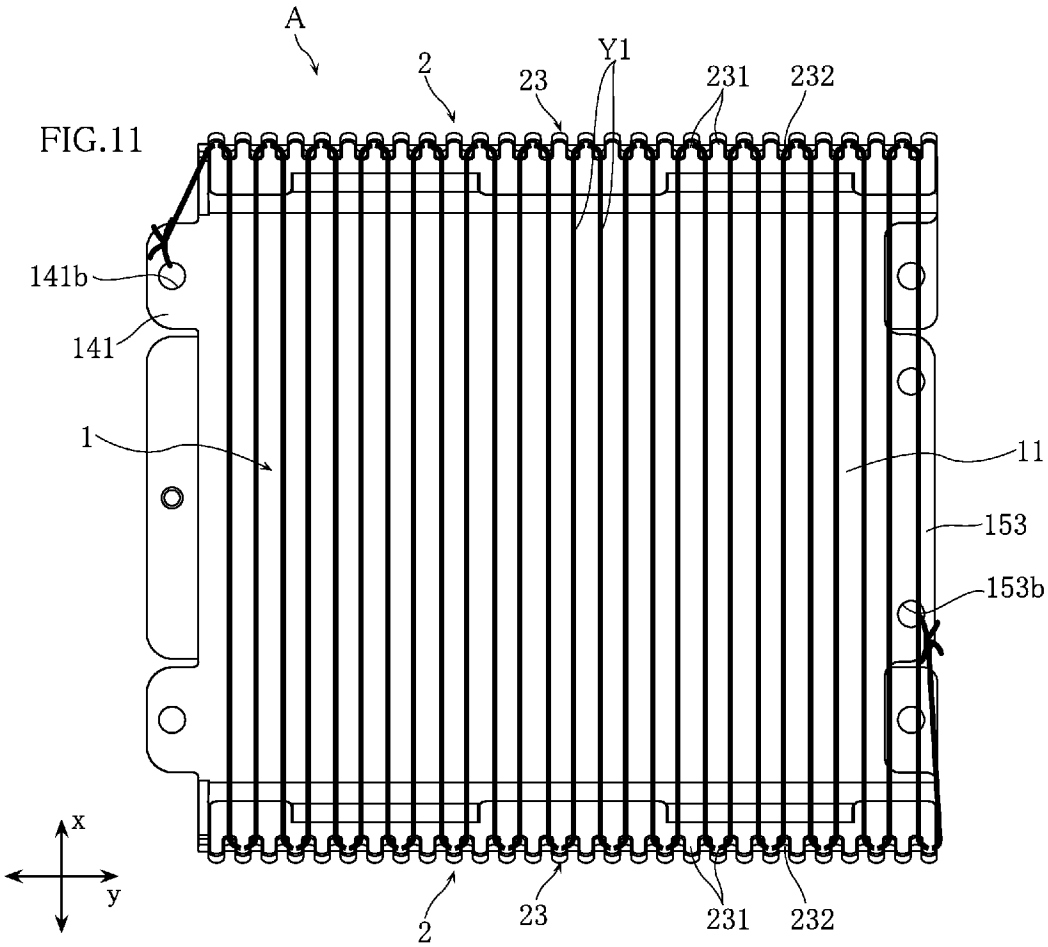
FIG. 11 is a plan view illustrating the method for using the weaving loom.

In this embodiment, a case of forming a general plain-woven fabric will be described. First, an end of a warp yarn Y1 made of yarn material such as woolen yarn is fixed. Specifically, for example, a leading end of the warp yarn Y1 is inserted through the through-hole 141*b* and is tied to the coupling plate 141. Next, the operation for causing the warp yarn Y1 to be caught around each projection 231 while being fitted into each groove 232 is repeated sequentially, starting from the left side of the pair of upper and lower yarn catch portions 23 in the figure. Accordingly, as shown in FIG. 11, the warp yarn Y1 is caught in parallel between the pair of yarn catch portions 23. After the warp yarn Y1 is caught in parallel, for example, a trailing end of the warp yarn Y1 is inserted through the through-hole 153*b* and is tied to the coupling plate 153. Although FIG. 11 shows the case in which the leading end of the warp yarn Y1 is inserted through the through-hole 141*b* positioned at the upper left in the figure, and the trailing end of the warp yarn Y1 is inserted through the through-hole 153*b* positioned at the lower right in the figure, the through-holes through which the leading end and the trailing end of the warp yarn Y1 are inserted and tied may be changed as appropriate.

Figure 12:
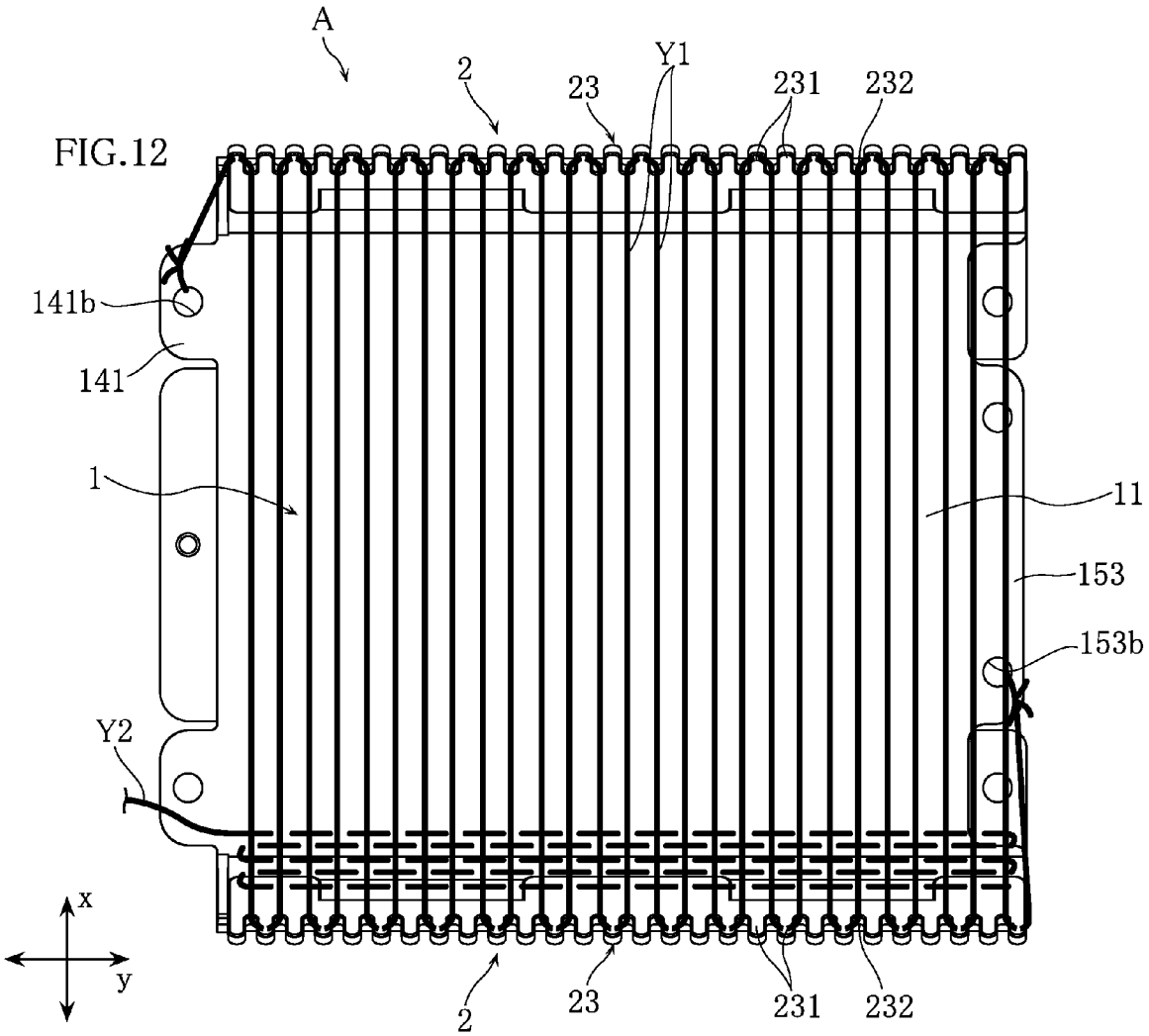
FIG. 12 is a plan view illustrating the method for using the weaving loom.
Figure 13:
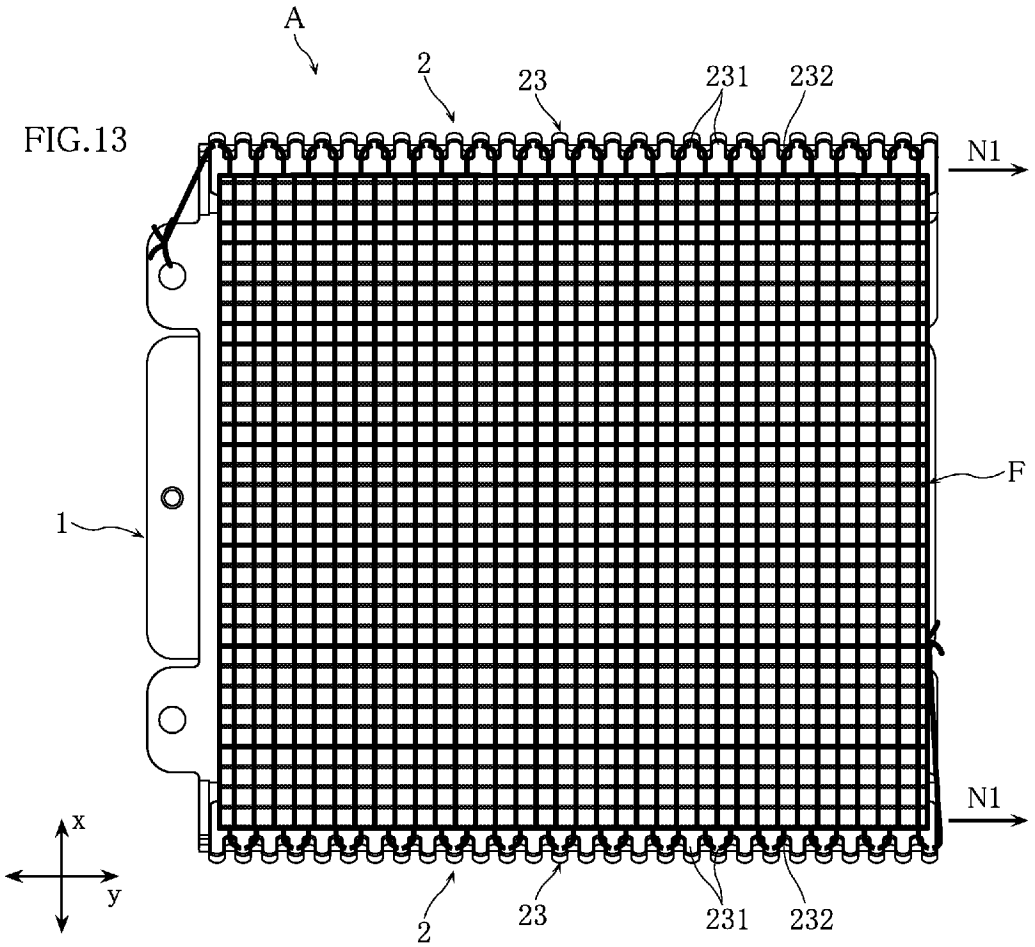
FIG. 13 is a plan view illustrating the method for using the weaving loom.

Then, the operation for passing a weft yarn is performed. As shown in FIG. 12, a weft yarn Y2 is passed, for example, alternately under and over adjacent portions of the warp yarn Y1, from one side of the warp yarn Y1 caught in parallel. This operation for passing the weft yarn Y2 is performed by winding the weft yarn Y2 in advance around a yarn holder, called a shuttle (not shown), and passing this shuttle under and over the warp yarn Y1 in a lateral direction as described above. When the weft yarn Y2 has been passed and completed the first row, the weft yarn Y2 is brought back at the other side of the warp yarn Y1. Subsequently, in the second row, the weft yarn Y2 is passed alternately over and under adjacent portions of the warp yarn Y1. In the third and following rows, the weft yarn Y2 is repeatedly passed as in the above-described cases of the weft yarn Y2 in the first and second rows. In this manner, a woven fabric F is formed as schematically shown in FIG. 13. Note that, when passing the weft yarn Y2, if it is difficult to directly pass the shuttle alternately under and over adjacent portions of the warp yarn Y1 as described above, a gap through which the shuttle is allowed to pass may be formed in advance. Such a gap is formed, for example, by passing a thin plate member (not shown) alternately under and over the warp yarn Y1 as described above, and then tilting the thin plate member upward. After the woven fabric F is formed, the tied leading end and trailing end of the warp yarn Y1 are untied from the coupling plates 141 and 153.

In the weaving loom A of this embodiment, the yarn catch members 2 are detachably attached to the inclined plates 12 (the main body 1). Each yarn catch member 2 attached to the corresponding inclined plate 12 is kept in a constant orientation in which the inclined plate 12 is held between the extending pieces 21 and 22. Accordingly, the weaving operation can be performed appropriately between the pair of yarn catch portions 23.

Furthermore, after the woven fabric F is formed using the weaving loom A, the woven fabric F can be easily released from the weaving loom A by detaching the yarn catch members 2 from the main body 1. Specifically, the pair of yarn catch members 2 shown in FIG. 13 can be detached from the main body 1 by sliding the yarn catch members 2 to one side in the direction y (side indicated by the arrow N1 in the figure). On the other hand, the opposite ends of the yarn catch members 2 in the direction y are abut against the stoppers 13, and, thus, the yarn catch members 2 are prevented by the stoppers 13 from moving to the opposite side in the direction y. With this configuration, the yarn catch members 2 can be easily attached to predetermined attachment positions.

Figure 14:
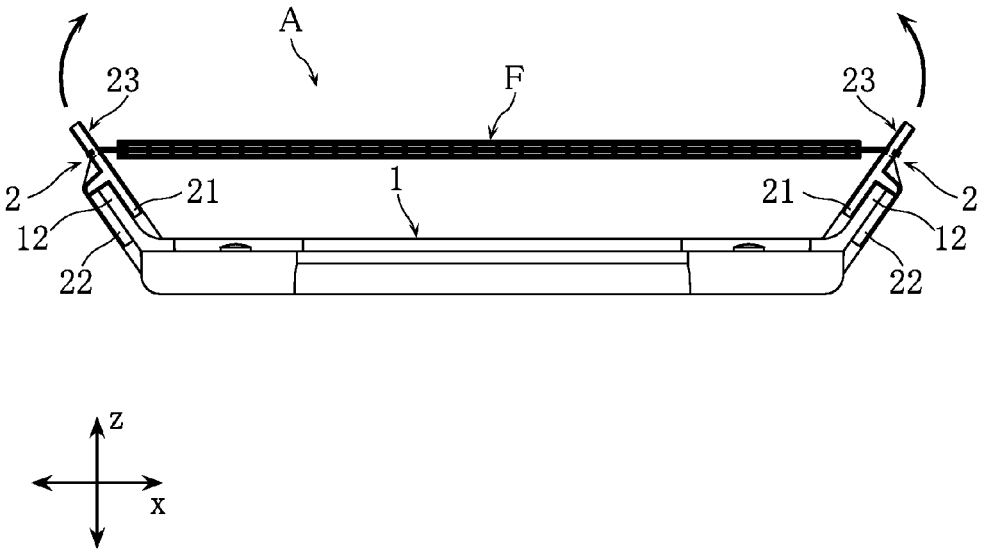
FIG. 14 is a right side view illustrating the method for using the weaving loom.

As another method for detaching the yarn catch members 2 from the main body 1, there is a method in which the yarn catch members 2 are pulled out upward from the inclined plates 12 as shown in FIG. 14. In a state where the woven fabric F has been formed, a certain level of binding force is exerted by the woven fabric F when an attempt is made to pull out the yarn catch members 2. The yarn catch members 2 can be detached from the main body 1 by pulling up the yarn catch members 2 against the binding force exerted by the woven fabric F. As described above, the plurality of extending pieces 21 and extending pieces 22 of each yarn catch member 2 holding the corresponding inclined plate 12 from both sides in the thickness direction are arranged so as to be spaced apart from each other in the direction y. Furthermore, the plurality or extending pieces 21 and the plurality of extending pieces 22 are positioned so as not to overlap each other when viewed in the thickness direction of the inclined plates 12. This configuration makes it relatively easy for the extending pieces 21 and 22 to elastically deform, thereby making it relatively easy to detach the yarn catch members 2.

When the yarn catch members 2 are attached to the inclined plates 12 (the main body 1), the protrusions 121 of the inclined plates 12 are fitted into the recesses 221 of the extending pieces 22. With this configuration, when the yarn catch members 2 are attached, the yarn catch members 2 are prevented from being accidentally displaced. Accordingly, the weaving operation using the weaving loom A can be performed appropriately.

When the weaving loom A is not in use, the space necessary to store or carry the weaving loom A can be reduced by detaching the pair of yarn catch members 2 from the main body 1. Furthermore, if the yarn catch members 2 are detached when the weaving loom A is not in use, accidental damage to the yarn catch portions 23 and the like can be suppressed.

Figure 15:
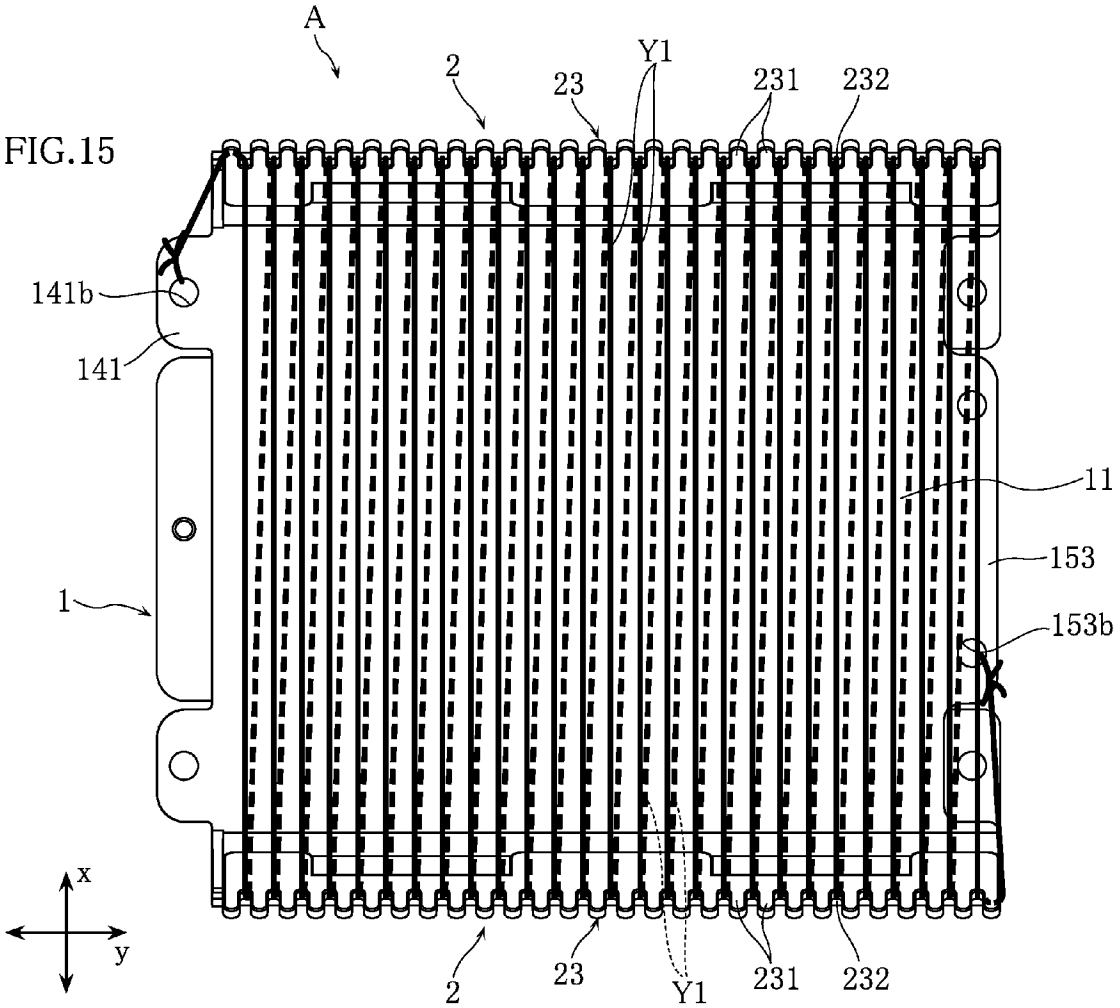
FIG. 15 is a plan view illustrating the method for using the weaving loom.
Figure 16:
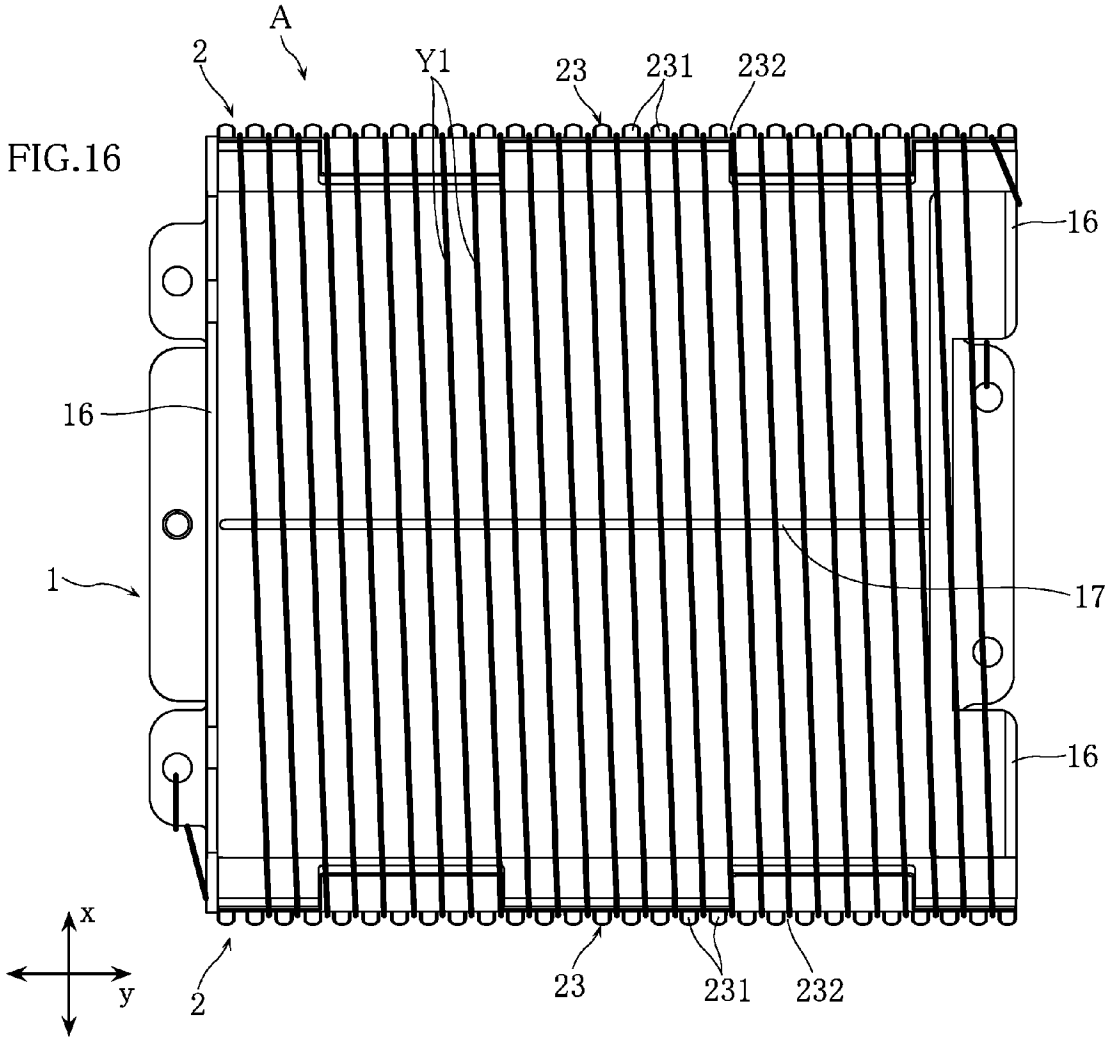
FIG. 16 is a bottom view illustrating the method for using the weaving loom.

Next, a weaving operation using a different method for catching the warp yarn Y1 will be described with reference to FIGS. 15 and 16. In the example shown in FIGS. 15 and 16, the warp yarn Y1 is passed over the lower face 11*a* of the base plate 11 as well. The warp yarn Y1 is wound around the base plate 11, and the warp yarn Y1 is sequentially fitted into the adjacent grooves 232. Accordingly, the warp yarn Y1 is caught between the pair of yarn catch portions 23 as shown in FIGS. 15 and 16. In FIG. 15, portions of the warp yarn Y1 wound over the lower face 11*a* are indicated by the broken lines. The procedure for passing the weft yarn 22 is as described above with reference to FIG. 12, and thus, a description thereof has been omitted. With this weaving operation, a woven fabric (not shown) similar to that in FIG. 13 is formed between the pair of yarn catch portions 23.

The lower face 11*a* of the base plate 11 is provided with the leg portions 16 projecting in the thickness direction z. Accordingly, for example, when performing the weaving operation (operation for passing the weft yarn Y2) in a state where the main body 1 (the weaving loom A) is placed on a table, the warp yarn Y1 wound over the lower face 11*a* is not in direct contact with the table. Thus, the weaving loom A can be stably placed on the table, and the weaving operation can be easily performed.

Figure 17:
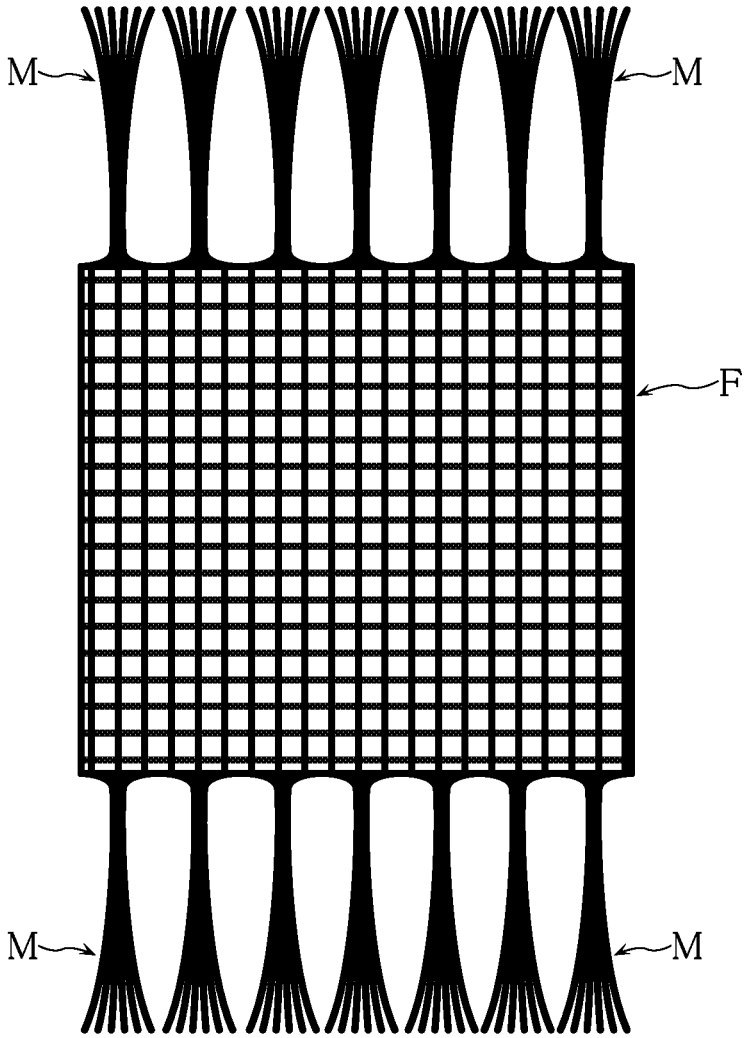
FIG. 17 is a view showing an example of a woven fabric formed using the weaving loom.

After the weaving operation is ended in the state of the warp yarn Y1 shown in FIG. 16, the warp yarn Y1 wound in parallel over the lower face 11*a* of the base plate 11 is cut at the middle. The lower face 11*a* of the base plate 11 is provided with the mark 11 positioned at the middle in the direction x. The warp yarn Y1 over the lower face 11*a* at the middle can be accurately cut along the mark 17. Cutting the warp yarn Y1 allows the woven fabric to be released from the pair of yarn catch portions 23. After the cut, a large number of portions of the warp yarn Y1 extend from the opposite sides of the woven fabric, and the lengths of these portions are substantially the same. The large number of portions of the warp yarn Y1 may be bundled in groups each having a plurality of portions as shown in FIG. 17, so that a plurality of tassels M having substantially the same size is formed.

As shown in FIG. 8, the weaving looms A of this embodiment can be coupled in the direction y. Using two weaving looms A coupled as shown in FIG. 3 allows for forming a larger woven fabric than when a single weaving loom A is used. It is also possible to couple three or more weaving looms A of this embodiment in the direction y.

Although a specific embodiment of the present invention has been described, the invention is not limited thereto, and various modifications can be made within the scope not departing from the spirit of the invention. Specific shapes, materials, and the like of the weaving loom according to the present invention are not limited to those in the foregoing embodiment.

The invention claimed is:

1. A handicraft weaving loom, comprising:

a main body including a base part and an inclined part formed integral with the base part, the base part including an upper face and a lower face, the main body further including a first edge portion and a second edge portion that are spaced apart from each other in a first direction, each edge portion extending in a second direction perpendicular to the first direction, the first edge portion being formed by the inclined part; and a first yarn catch member including a yarn catch portion for holding threads in parallel, the first yarn catch member being detachably attached to the first edge portion of the main body.

2. The weaving loom according to claim 1, further comprising a second yearn catch member detachably attached to the second edge portion of the main body.

3. The weaving loom according to claim 1, wherein the first yarn catch member is slidable along the first edge portion.

4. The weaving loom according to claim 3, wherein the main body is provided with a slide stopper to come into contact with the first yarn catch member.

5. A handicraft weaving loom, comprising:

a main body including a base part and an inclined part formed integral with the base part, the base plate including an upper face and a lower face, the main body further including a first edge portion and a second edge portion that are spaced apart from each other in a first direction, each edge portion extending in a second direction perpendicular to the first direction, the first edge portion being formed by the inclined part; and a first yarn catch member including a yarn catch portion for holding threads in parallel, the first yarn catch member being detachably attached to the first edge portion of the main body wherein the first yarn catch member further comprises a first extension and a second extension that are disposed opposite to the yarn catch portion and flanked by the inclined plate in a thickness direction of the inclined plate.

6. The weaving loom according to claim 5, wherein each of the first extension and the second extension comprises a plurality of extending pieces spaced apart from each other in the second direction, and the plurality of extending pieces of the first extension do not overlap with the plurality of extending pieces of the second extension as viewed in the thickness direction of the inclined plate.

7. The weaving loom according to claim 5, wherein the first yarn catch member and the inclined plate are formed with a first engagement portion and a second engagement portion, respectively, the first and the second engagement portions being configured to come into engagement with each other.

8. The weaving loom according to claim 7, wherein the first engagement portion is provided at one of the first extension and the second extension.

9. The weaving loom according to claim 7, wherein one of the first and the second engagement portions comprises a recess, and the other one of the first and the second engagement portions comprises a protrusion to be fitted into the recess.

10. The weaving loom according to claim 5, wherein the lower face of the base plate is provided with a leg projecting in the thickness direction of the base plate.

11. The weaving loom according to claim 5, wherein the lower face of the base plate is provided with a mark positioned at a middle of the base plate in the first direction.

12. The weaving loom according to claim 1, wherein the main body is provided with a coupling portion for coupling with another weaving loom.

13. The weaving loom according to claim 12, wherein the coupling portion comprises a separation preventing structure that prevents detachment of the another weaving loom.

14. The weaving loom according to claim 1, wherein an angle of the inclined part relative to the base part is more than 90 degrees.

15. The weaving loom according to claim 5, wherein an angle of the inclined plate relative to the base plate is more than 90 degrees.

16. A handicraft weaving loom, comprising:

a main body including a first edge portion and a second edge portion that are spaced apart from each other in a first direction, each edge portion extending in a second direction perpendicular to the first direction; and a first yarn catch member including a yarn catch portion for holding threads in parallel, the first yarn catch member being detachably attached to the first edge portion of the main body, wherein the first yarn catch member further includes a first part and a second part that are disposed opposite to the yarn catch portion and flanked by a part of the main body.

17. The handicraft weaving loom according to claim 16, wherein the part of the main body is a portion extended from the main body and disposed between the first part and the second part of the first yarn catch member.

18. The handicraft weaving loom according to claim 17, wherein the portion extended from the main body is inclined with respect to the main body.

* * * * *